US006939245B1

(12) United States Patent
Mullarkey

(10) Patent No.: US 6,939,245 B1
(45) Date of Patent: Sep. 6, 2005

(54) TRAINING AID FOR GOLFERS

(76) Inventor: Richard R Mullarkey, 40 Carriage Way, Freehold, NJ (US) 07728

( * ) Notice: Subject to any disclaimer, the term of this patent is extended or adjusted under 35 U.S.C. 154(b) by 0 days.

(21) Appl. No.: 10/760,094

(22) Filed: Jan. 17, 2004

(51) Int. Cl.[7] ..... A63B 69/36
(52) U.S. Cl. ..... 473/268; 473/209; 362/191
(58) Field of Search ..... 473/207–211, 266–267; 362/103, 105, 190, 191, 259; 2/195.1, 209.13; 24/3.1, 3.11, 3.12; 224/181

(56) References Cited

U.S. PATENT DOCUMENTS

| | | | | | |
|---|---|---|---|---|---|
| 1,169,188 | A | | 1/1916 | Peck | |
| 1,318,850 | A | | 10/1919 | De Yong | |
| 2,524,881 | A | | 10/1950 | Chambers | |
| 3,032,647 | A | | 5/1962 | Wansky et al. | |
| 4,303,244 | A | | 12/1981 | Uppvall | |
| 4,406,040 | A | | 9/1983 | Cannone | |
| 4,967,323 | A | * | 10/1990 | Johnson et al. | 362/103 |
| 5,284,345 | A | * | 2/1994 | Jehn | 473/209 |
| 5,541,816 | A | * | 7/1996 | Miserendino | 362/106 |
| 5,658,065 | A | * | 8/1997 | Jamieson | 362/106 |
| 5,738,595 | A | * | 4/1998 | Carney | 473/209 |
| 5,879,239 | A | | 3/1999 | Macroglou | |
| 6,022,126 | A | * | 2/2000 | Sekine et al. | 362/259 |
| 6,070,987 | A | * | 6/2000 | Jarvik | 362/84 |
| 6,247,205 | B1 | * | 6/2001 | Damadian et al. | 24/3.12 |
| 6,431,732 | B1 | * | 8/2002 | Brown et al. | 362/259 |
| 6,467,929 | B2 | * | 10/2002 | Lee | 362/191 |
| 6,616,294 | B1 | | 9/2003 | Henry | |
| 6,634,031 | B1 | | 10/2003 | Schlapkohl | |
| 6,672,972 | B1 | * | 1/2004 | Stone | 473/207 |
| 6,764,194 | B1 | * | 7/2004 | Cooper | 362/105 |
| 2003/0045368 | A1 | | 3/2003 | Farmer et al. | |

* cited by examiner

*Primary Examiner*—Gregory Vidovich
*Assistant Examiner*—Nini F. Legesse
(74) *Attorney, Agent, or Firm*—Michael I. Kroll

(57) ABSTRACT

The present invention 10 discloses a training aid for golfers. The device 10 is designed to generate a collimated beam of red light 20 from a device 10 that is selectively attached to the brim 16 of a hat 18. Once attached to the hat 18, the golfer 12 positions their head to a desired point whereupon the light-emitting apparatus 14 is hingedly 24 adjusted to project the laser light onto the golf ball 22 thereby enabling the golfer 12 to easily ascertain whether there is unwanted head movement during the golf swing. The device 10 is comprised of a laser beam emitter 14 having an on/off switch 28 and a clip 26 for attaching the device to the brim of a hat and a hinge 24 positioned between the emitter and hat attachment means providing pivotal adjustment of the emitter.

1 Claim, 7 Drawing Sheets

TRAINING AID FOR GOLFERS

BACKGROUND OF THE INVENTION

1. Field of the Invention

The present invention relates generally to training aids and, more specifically, to a training aid for golfers. The device is designed to generate a collimated beam of red light from a device that is selectively attached to the brim of a hat. Once attached to the hat, the golfer positions their head to a desired point whereupon the light emitting apparatus is hingedly adjusted to project the laser light onto the golf ball, enabling the golfer to easily ascertain whether there is unwanted head movement during the golf swing.

The device is comprised of a laser beam emitter having an on/off switch and a clip for attaching the device to the brim of a hat and a hinge positioned between the emitter and hat attachment means providing pivotal adjustment of the emitter.

2. Description of the Prior Art

There are other light emitter device designed for attachment to a hat. Typical of these is U.S. Pat. No. 1,169,188 issued to Peck on Jan. 25, 1916.

Another patent was issued to DeYong on Oct. 14, 1919 as U.S. Pat. No. 1,318,850. Yet another U.S. Pat. No. 2,524,881 was issued to Chambers on Oct. 10, 1950 and still yet another was issued on May 1, 1962 to Wansky, et al. as U.S. Pat. No. 3,032,647.

Another patent was issued to Uppvall on Dec. 1, 1981 as U.S. Pat. No. 4,303,244. Yet another U.S. Pat. No. 4,406,040 was issued to Cannone on Sep. 27, 1983. Another was issued to Macroglou on Mar. 9, 1999 as U.S. Pat. No. 5,879,239 and still yet another was issued on Sep. 9, 2003 to Henry as U.S. Pat. No. 6,616,294.

Another patent was issued to Schlapkohl on Oct. 21, 2003 as U.S. Pat. No. 6,634,031. Yet another U.S. Patent Application Publication No. 2003/0045368 was filed by Farmer, et al. on Mar. 6, 2003. Another was issued to Berry on Jun. 26, 1935 as U.K. Patent No. 430,844 and still yet another was published on Nov. 12, 1998 to Varriano as WIPO Publication No. WO 98/50118.

A device of the class described comprising a sight having means for mounting it on the head of a golf player in the line of vision between the player's eyes and the ball.

In a device of the character described, in combination with an attaching body, a rod having its inner end rotatably connected to the body, a disk carried by the rod having its outer edge turned inwardly and contacting with the adjacent face of the body and also provided with a circle of ratchet teeth, a holder connected to the outer end of the rod, and a resilient pawl arranged in the space between the inner face of the main portion of the disk and the adjacent face of the attaching body and. having its curved spring body secured at its inner end to the attaching body and terminating at its outer end in an engaging head designed to coact with the ratchet teeth so as to in consequence maintain the holder in various positions of adjustment.

A lighting implement adapted to clasp onto a supporting article and hold a battery and a bulb in closed electrical circuit, said lighting implement comprising, a base member of current conducting spring-like material defining an elongated base portion having a clasp portion at one end thereof folded back thereupon and resiliently convergent therewith to claspingly receive a supporting article therebetween, battery holding clamp means, joined to said elongated base portion to clampingly receive a battery and form electrical connection between the elongated base portion and the battery, and a bulb retaining coil spring carried by said base portion in alignment with said battery holding clamp means to retain a bulb in direct contact with said battery and in series electrical connection with said base portion.

A flashlight comprising a non-conducting sectional carrier case having top and bottom sections, leaf clip means secured to the bottom of said case on the outer surface thereof and extending depthwise thereof for securing the flashlight to a support, spaced spring contact arms positioned within said case and adapted to receive battery means therebetween, vertically extending tapered post formed with one section of said carrier case and extending in the direction of between the bottom and top thereof, said contact arms having sections extending to adjacent positions in said case, means securing said case sections together, said contact arms having loop means thereon individually engaging different ones of said posts to be positioned thereby at a desired position between the top and bottom of said case, circuit completion means in said case and including a light bulb in the circuit thereof, said circuit completion means engaging one of said contact arms, and a contact member positioned on said case and engaging the other of said contact arms to move into engagement with said circuit completion means and operate the flashlight.

A golf putting training device comprised of a cap with light emitter adapted to project a spot beam of light to a first position before a golfer putts, said spot to be observed by the golfer immediately after putting to see if the spot beam is in a second position, the distance between the first and second position indicating improper movement of the head of the golfer during putting.

This invention is related to illumination devices and more particularly to flashlights and flashlight holding implements. A flashlight holding implement and flashlight is attached to a hat brim and enables the user to direct and adjust the angular position of the light beam, and eliminate the need for the user to hand-hold the flashlight while performing the task before him.

The present invention provides a device and method for assisting a person in achieving proper alignment. The device and method are particularly useful for achieving proper alignment for a golf stroke in which a golf ball is struck to move towards a target. In one embodiment, the device comprises a support member to be worn by the person. A light source is attached to the support member. The light source is adapted to generate a generally linear, visible alignment beam of light on the ground in front of the person when the person is in position to perform a task. The alignment beam is generally parallel to an alignment of the portion of the person's body upon which the support member is worn and, thus, provides an indication of such alignment readily visible to the user in real time.

A flashlight holder for use with a conventional hart hat to releasably receive a flashlight of the type defining a faceted barrel and a head which is rotatable relative to the barrel for operation of the flashlight. The flashlight holder is designed such that a flashlight is operable with one hand when retained in the flashlight holder. The flashlight holder defines a barrel support secured to a base. The barrel support defines an interior surface and a slot configured to cooperate to closely receive and retain the flashlight barrel in a non-rotatable manner. The base of the flashlight holder defines a tab configured to be releasably engaged within a slotted receptacle defined by the hard hat. A locking projection extends from the tab for engaging a lower edge of the hard hat.

An illumination system for a hat is provided. The system includes a light pivotally connected to an attachment mechanism constructed of hook and latch material. The hook and latch material is provided around an adjustment band of a typical "baseball cap." Batteries and a touch-sensitive switch are coupled to the light with the touch sensitive switch facing inward. The cap is usable in its standard orientation during the day to shield the suns rays from the user's eyes. At night, or indoors, the cap may be reversed. Whereas in the standard orientation the touch-sensitive switch is blocked from contact with the skin by the user's hair, in the reversed orientation the touch sensitive switch contacts the user's forehead, thereby actuating the light automatically for use.

A training aid has a light beam generator adjustably mounted to a universal joint fixture which is in turn held by a support strip in outwardly spaced relation away from a golfer's cap bill with the assistance of a spring clip. In use, the generator is adjusted to project a spot or beam onto the ground or a golf ball. On a golfer swinging a club at the light beam spot, any unwanted body or head movement is immediately indicated to the golfer by movement of the light beam spot. Preferably, the generator is a laser beam generator.

A golf swing corrector comprising a plurality of optically aligned and spaced aperture sights to be located adjacent the normal position a golf ball would occupy in respect to a player and which, when viewed by the player in relation to a spot of light, are seen superimposed in symmetrical relationship and, in the event of movement of the player's head occurring during a stroke, afford a visual indication of the direction and extent of such movement by the consequential asymmetry produced thereby.

A gold, tennis or baseball training apparatus to align the eyes, striking implement and stationary or moving ball to be struck, upon impact. A cap for the user has a radiation emitting device mounted to project radiation along the vision path. A radiation detector, an impact detector and a light signaling device are mounted on the striking implement. Processing and decoding circuitry and sound signaling means are mounted on the striking implement or the user. A light or sound signal can signal proper alignment to the user on impact (i.e., essentially simultaneous actuation of radiation and impact detection), and/or can signal improper alignment to the user on impact. The sound signal may be a high or low frequency signal or words from a voice chip. Adjustable radiating beam widths may be used for different levels of skills.

While these golf aids may be suitable for the purposes for which they were designed, they would not be as suitable for the purposes of the present invention, as hereinafter described.

SUMMARY OF THE PRESENT INVENTION

The present invention discloses a training aid for golfers. The device is designed to generate a collimated beam of red light from a device that is selectively attached to the brim of a hat. Once attached to the hat, the golfer positions their head to a desired point whereupon the light-emitting apparatus is hingedly adjusted to project the laser light onto the golf ball thereby enabling the golfer to easily ascertain whether there is unwanted head movement during the golf swing. The device is comprised of a laser beam emitter having an on/off switch and a clip for attaching the device to the brim of a hat and a hinge positioned between the emitter and hat attachment means providing pivotal adjustment of the emitter.

A primary object of the present invention is to provide a golf aid for golfers.

Another object of the present invention is to provide a golf aid that can be selectively attached to the brim of a hat.

Yet another object of the present invention is to provide means for attaching the golf-aid to the brim of a hat.

Still yet another object of the present invention is to provide a golf-aid having means for generating a beam of light.

Another object of the present invention is to provide a golf-aid having means for directing said beam of light.

Yet another object of the present invention is to provide a golf-aid having a clip for attaching the golf-aid to the brim of a hat.

Still yet another object of the present invention is to provide a golf-aid having a laser beam emitter.

Another object of the present invention is to provide a golf-aid having a hinge disposed between said clip and said laser beam emitter.

Yet another object of the present invention is to provide a laser beam emitter that generates a red beam.

Additional objects of the present invention will appear as the description proceeds.

The present invention overcomes the shortcomings of the prior art by providing a training aid for golfers designed to generate a collimated beam of red light from a device that is selectively attached to the brim of a hat. Once attached to the hat, the golfer positions their head to a desired point whereupon the light emitting apparatus is hingedly adjusted to project the laser light onto the golf ball, enabling the golfer to easily ascertain whether there is unwanted head movement during the golf swing.

The device is comprised of a laser beam emitter having an on/off switch and a clip for attaching the device to the brim of a hat and a hinge positioned between the emitter and hat attachment means providing pivotal adjustment of the emitter.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
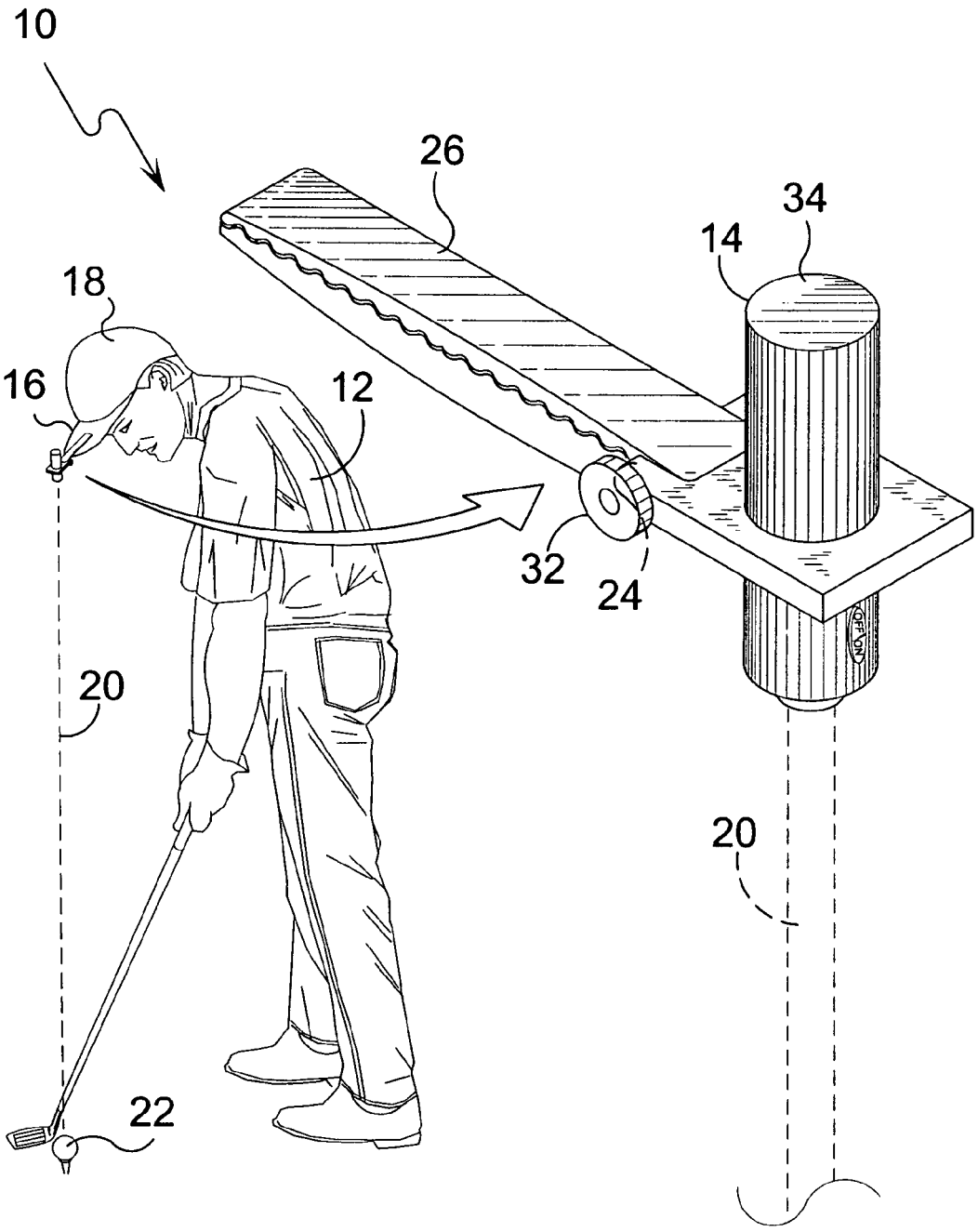
FIG. 1 is an illustrative view of the present invention in use.

With regard to reference numerals used, the following numbering is used throughout the drawings.

10 present invention
12 golfer
14 light source
16 brim
18 cap
20 beam of light
22 target
24 hinge
26 clip
28 on/off switch
30 club
32 adjusting knob
34 housing

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 is a training aid for golfers 12 providing a device for assisting a golfer in achieving proper alignment with a golf stroke by providing a housing 34 having a collimated light source member 14 worn on the brim 16 of a cap or visor 18 with clip 26. The collimated light source generator 14 is adapted to produce generally linear, parallel visible beams of light 20. In the preferred embodiment, the beam is expected to be red for projection onto a target 22 positioned in the front of the user 12. The idea being that a golfer 12 will position their body to address the ball 22 with the beam 20 projected onto the ball using the hinge 24 having an adjustment knob 32 for angular adjustment, whereupon they will endeavor to execute their golf swing without movement of the point of light 20 on the ball 22 surface keeping eye contact through their swing thereby eliminating slicing, topping or hooking the ball due to unwanted head movement.

Figure 2:
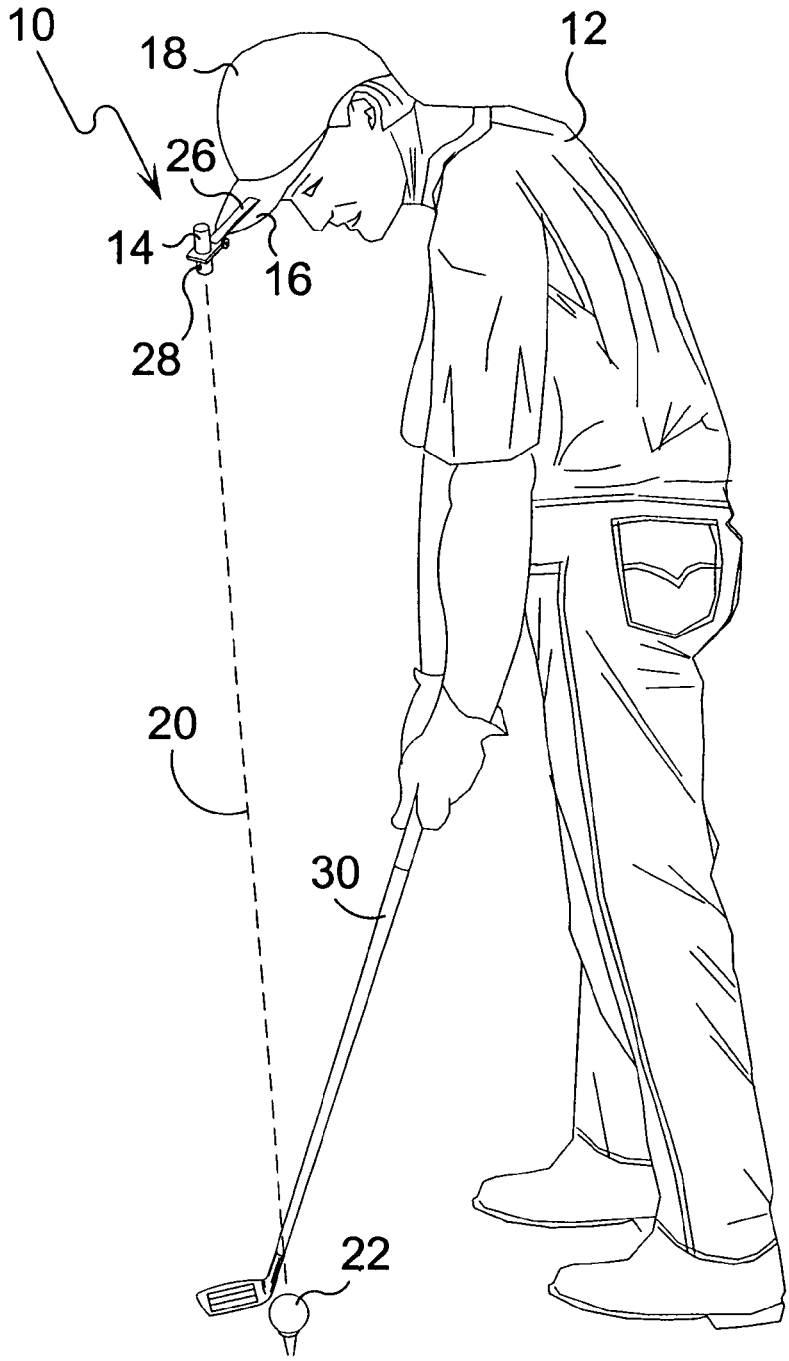
FIG. 2 is an illustrative view of the present invention in use.

Turning to FIG. 2, shown therein is an illustrative view of the present invention 10 in use. Shown is the present invention 10 in use being a training aid for golfers 12 that provides a device for assisting a golfer in achieving proper alignment with a golf stroke by providing a light beam generating member 14 attachable to the brim 16 of a cap 18 or visor by means of a clip 26 and having angular adjustment means in the form of a hinge located between the light generating member 14 and the clip 26. In the preferred embodiment, the light beam 20 will be red and collimated, such as laser light with an exteriorly positioned switch 28 for enabling or disabling beam generation. Also shown are the golf club 30 and ball 22.

Figure 3:
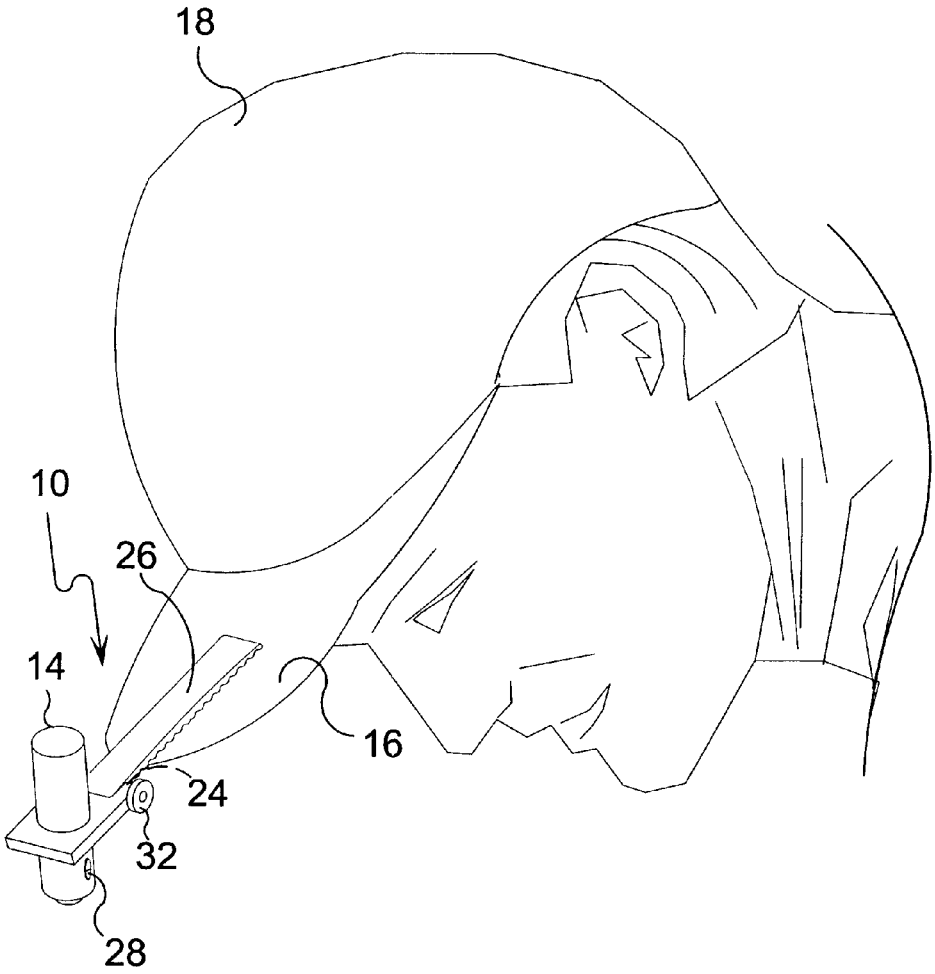
FIG. 3 is an enlarged view of the present invention in use.

Turning to FIG. 3, shown therein is an enlarged view of the present invention 10 in use. Shown is the present invention 10 attached to the brim 16 of a cap 18 by means of a clip 26. The device 10 is designed as a training aid for golfers by providing a light source 14 in a housing for projecting a beam of light onto a golf ball whereupon a golfer will execute their golf swing while concentrating on keeping the light spot steady and maintaining eye contact through their swing. The device 10 has an internal replaceable power source and an on/off switch 28 for engaging and disengaging beam generation. In the preferred embodiment, the beam is a red collimated beam such as that generated by a laser. There is also a hinge 24 with adjusting knob 32 positioned between the clip and light housing providing angular adjustment.

Figure 4:
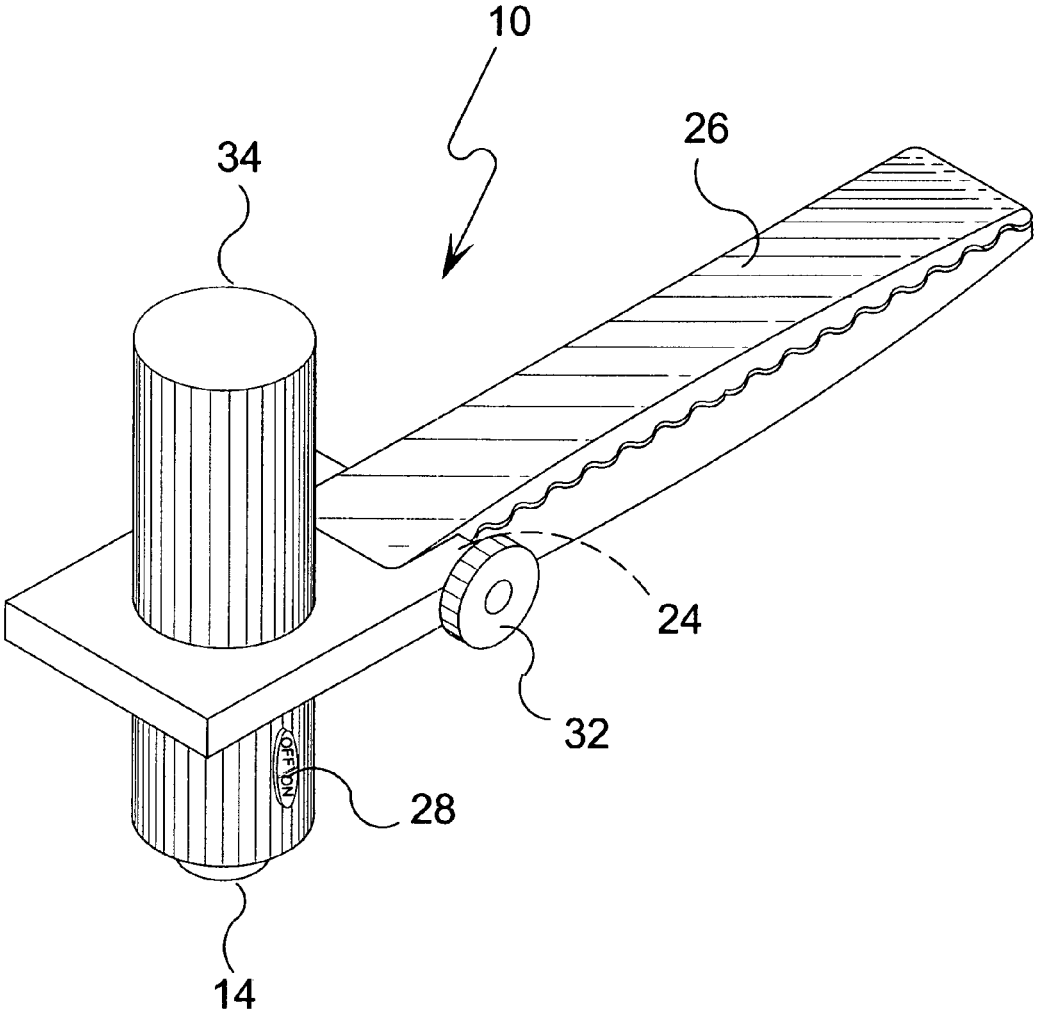
FIG. 4 is a perspective view of the present invention.

Turning to FIG. 4, shown therein is a perspective view of the present invention 10. Shown is a perspective view of the present invention 10 comprising a device having a housing 34 attachable to a hat or the like by means of a clip 26 and a hinge 24 with adjustment knob 32 for angular adjustment of the housing. The housing 34 incorporates a power source and light generating components 14 with an exteriorly positioned switch 28 for engaging and disengaging beam generation. In the preferred embodiment, it is expected that the light generating module emits a collimated red beam of laser light that will be directed by means of golfer head position and device hinge onto the surface of a ball wherein the golfer will attempt to maintain the spot of light on the surface of the ball during execution of their golf swing while maintaining eye contact. The training aid will teach the golfer to eliminate unwanted head movement that can cause slicing, topping and hooking of the ball.

Figure 5:
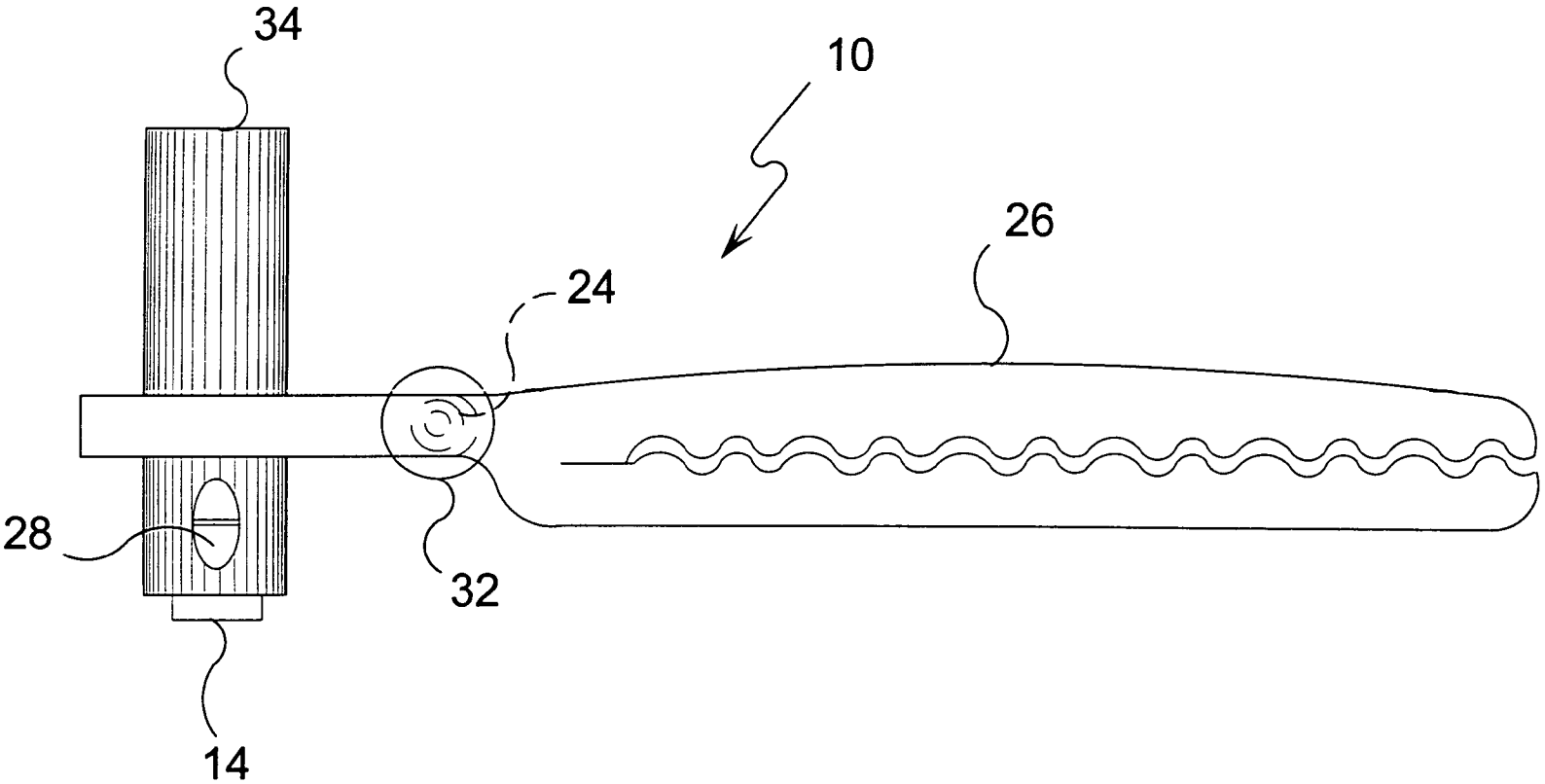
FIG. 5 is a side view of the present invention.

Turning to FIG. 5, shown therein is a side view of the present invention 10. Shown is a side view of the present invention 10 being a training aid for golfers that provides a device for assisting a golfer in achieving proper alignment of a golf stroke by providing an attachable detachable light source 14 member worn on the brim of a cap or visor. The device 10 is comprised of a housing 34 with attachment means in the form of a clip 26 and a light generating module having an exteriorly located switch 28 for engaging and disengaging beam generation. The light generating module 14 generates a collimated beam of light that is positioned to project onto the surface of a golf ball as an aid in keeping the head steady and maintaining eye contact with the ball during a golf swing. The positioning of the light beam can be adjusted through pivotal rotation of the light generating module relative to the clip by means of a hinge 24 with adjustment knob 32 positioned therebetween.

Figure 6:
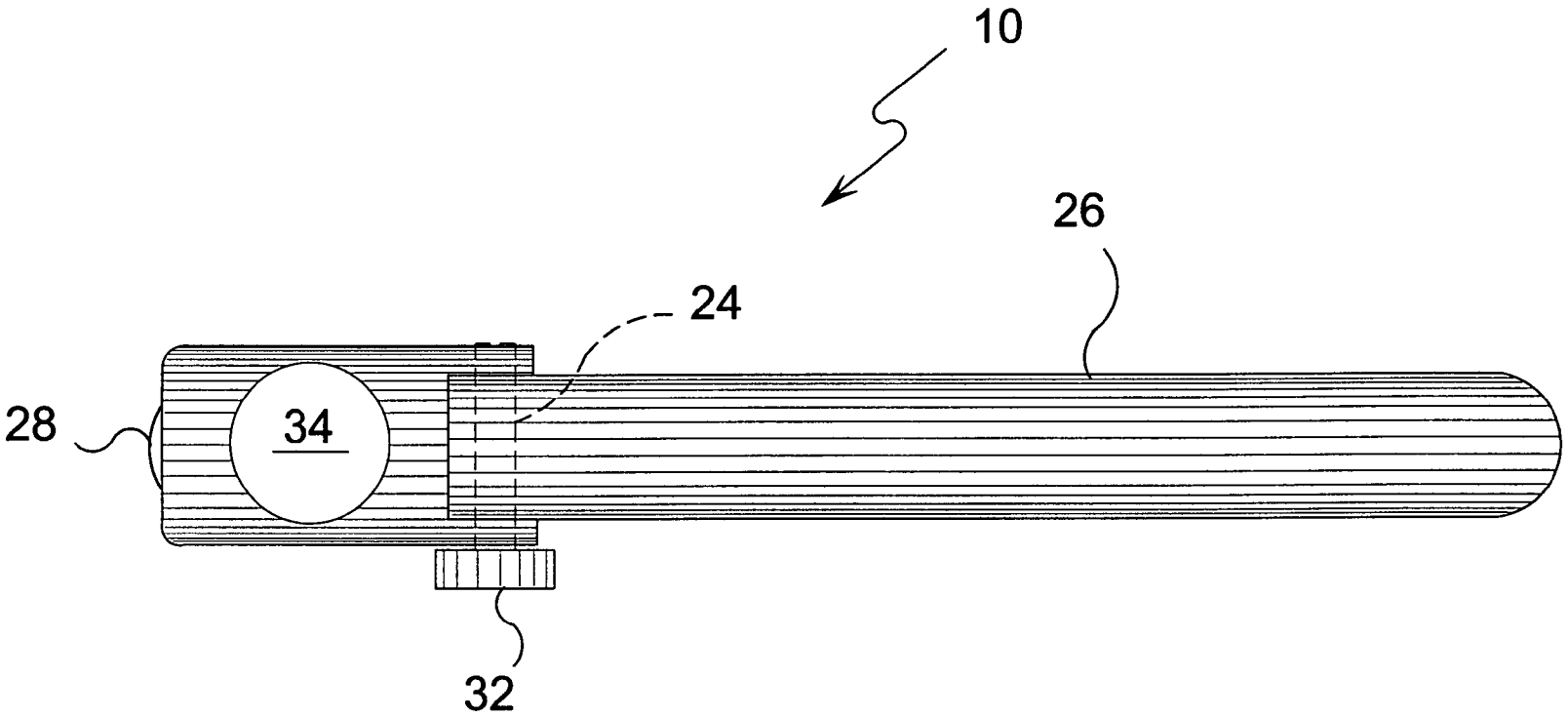
FIG. 6 is a top view of the present invention.

Turning to FIG. 6, shown therein is a top view of the present invention 10. Shown is a top view of the present invention 10 being a training aid for golfers that provides a device for assisting a golfer in achieving proper alignment of a golf stroke by providing an attachable detachable light source member worn on the brim of a cap or visor. The device 10 is comprised of a housing 34 having attachment means in the form of a clip 26 and a light generating module having an exteriorly located switch 28 for engaging and disengaging beam generation. The light generating module generates a collimated beam of light and in the preferred embodiment is expected to be red, and is positioned to project onto the surface of a golf ball as an aid in keeping the head steady and maintaining eye contact with the ball during a golf swing. The positioning of the light beam can be adjusted through pivotal rotation of the light generating module relative to the clip 26 by means of a hinge 24 with adjustment knob 32 positioned therebetween.

Figure 7:
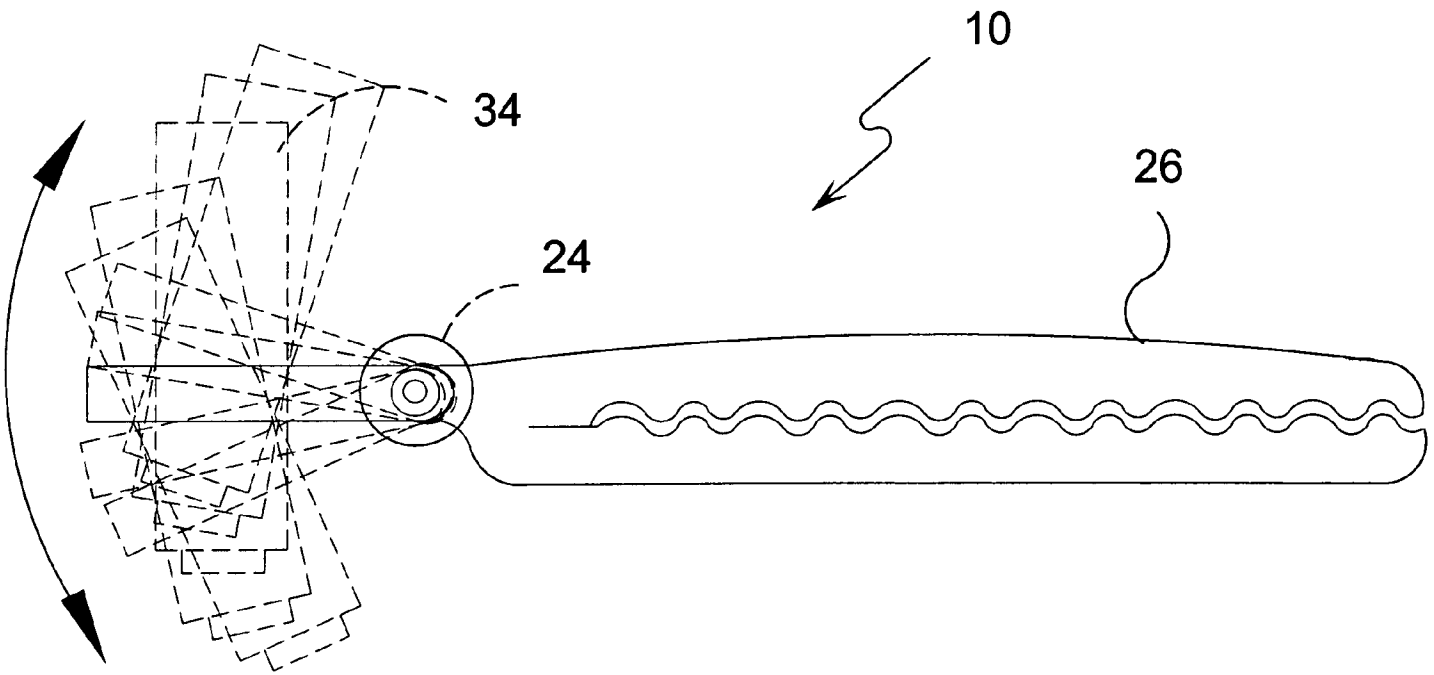
FIG. 7 is a side view of the present invention and its adjustable feature.

Turning to FIG. 7, shown therein is a side view of the present invention 10 and its adjustable feature. Shown is a view of the present invention 10 being a training aid for golfers providing a device for assisting a golfer in achieving proper alignment with a golf stroke and provides a collimated light source member worn on the brim of a cap or visor. The collimated light source beam is adapted to generate a generally linear, visible alignment beam of light to a target positioned in the front of the user. The beam housing 34 is pivotal relative to the cap having the device 10 mounted thereupon, and provides a collimated beam visible to the user in real time. The device 10 includes a power source and beam generator within the housing, pivotally connected to a clip portion 26 having a hinge 24 for angular adjustment of the device 10.

I claim:

1. A training aid for a golfer for attachment to and in combination with the brim of a hat or sun visor being worn on the head of the golfer, a golf club and a golf ball about to be struck, consisting of:

a) a housing for containing the training aid;

b) a source of collimated light being disposed internal said housing, wherein said light source generates a beam of red light, wherein said light beam is directed downwardly toward said golf ball which golf ball the golfer is about to hit with said golf club;

c) wherein said housing is adapted for attachment to the brim; and, d) an angular adjustment member consisting of a hinge for adjusting the angle between said housing and the brim to permit the beam of light to be adjusted with respect to the ball;

e) a clip for attaching said housing to a front edge of the brim to permit the housing to be attached to and removed from the brim, said clip having a top member and a bottom member sandwiching said brim therebetween, edges of said top and bottom members in contact with said brim being ridged;

f) an adjusting knob being disposed on said hinge to adjust the angle of said hinge;

g) said housing being cylindrically shaped having first and second opposing ends, wherein said light source is disposed in said first end of said housing; and h) said clip being attached to said housing between said first and second ends of said housing.

* * * * *